US005776206A

United States Patent [19]

Kleber

[11] Patent Number: 5,776,206

[45] Date of Patent: Jul. 7, 1998

[54] SURFACTANT MIXTURE FOR TEXTILE TREATMENT

[75] Inventor: Rolf Kleber, Neu-Isenburg, Germany

[73] Assignee: Hoechst Aktiengesellschaft, Frankfurt, Germany

[21] Appl. No.: 646,985

[22] Filed: May 8, 1996

[30] Foreign Application Priority Data

May 10, 1995 [DE] Germany ..... 195 17 033.4

[51] Int. Cl.[6] ..... C11D 1/72; C11D 1/02; C11D 1/722

[52] U.S. Cl. ..... 8/137; 252/351; 510/356; 510/422; 510/506; 510/535

[58] Field of Search ..... 252/351, 243; 510/283, 421, 299, 281, 422, 506, 356, 528, 535; 8/137

[56] References Cited

U.S. PATENT DOCUMENTS

| | | | |
|---|---|---|---|
| 4,155,856 | 5/1979 | Reinert et al. | 252/351 |
| 4,247,408 | 1/1981 | Imamura et al. | 510/421 |
| 5,324,443 | 6/1994 | Arif et al. | 510/421 |
| 5,403,508 | 4/1995 | Reng et al. | 510/119 |
| 5,484,553 | 1/1996 | Guth et al. | 252/351 |
| 5,489,396 | 2/1996 | Bous | 510/110 |
| 5,501,813 | 3/1996 | Fischer et al. | 510/421 |

FOREIGN PATENT DOCUMENTS

| | | | |
|---|---|---|---|
| 0 420 802 | 4/1991 | European Pat. Off. . | |
| 0 569 843 | 11/1993 | European Pat. Off. . | |
| 42 32 210 | 4/1993 | Germany . | |
| 43 27 327 | 2/1995 | Germany . | |
| 6-158091 | 6/1994 | Japan | 252/243 |
| 91/00331 | 1/1991 | WIPO . | |

OTHER PUBLICATIONS

Database WPIDS on STN, week 9427, London: Derwent Publications, Ltd., AN-94-222329, Class A97, JP 06158091 A (Lion Corp), abstract, 1994.

*Primary Examiner*—Richard D. Lovering
*Assistant Examiner*—Daniel S. Metzmaier
*Attorney, Agent, or Firm*—Connolly and Hutz

[57] ABSTRACT

Surfactant mixture comprising

33–95 parts by weight of at least one alkoxylated $C_9$–$C_{18}$ fatty alcohol (component I) having 5 to 30 oxyalkylene groups and 5–67 parts by weight of at least one alkoxylated $C_9$–$C_{18}$ fatty acid (component II) having 5 to 30 oxyalkylene groups or 5–67 parts by weight of at least one alkoxylated $C_1$–$C_6$ alcohol (component III) having 5 to 30 oxyalkylene groups or 5–67 parts by weight of a mixture of at least one alkoxylated fatty acid (component II) and at least one alkoxylated alcohol (component III).

13 Claims, No Drawings

SURFACTANT MIXTURE FOR TEXTILE TREATMENT

BACKGROUND OF THE INVENTION

1. Field of the Invention

The use of surfactants, usually anionic or nonionic in kind, in the textile pretreatment of specifically cellulosic fibers is well known.

2. Description of the Prior Art

The textile pretreatment of man-made fibers removes the manufacturer's spin finishes, further-processing finishes and coning oils from the fibers. From wovens specifically of cellulosic fibers the pretreatment removes sizes, inter alia. In the case of knits, including cellulosics, the primary concern is the removal of further-processing finishes and coning oils.

All these processes involve a thorough wash in an aqueous medium with surfactants.

In a modern finishing operation, the textile pretreatment auxiliaries are metered into the textile pretreatment stage in liquid form by directly pumping the products from the drums in which they were supplied by the textile auxiliaries manufacturer into the washers.

For a surfactant to be used in today's pretreatment it has to be liquid and pumpable.

The other properties desired of a textile pretreatment surfactant besides detergency are wettability, emulsifiability, foam control and good released-soil dispersion.

With many surfactants good pumpability is frequently achieved by deep dilution with water to an active content of about 20–30%, since nonionic aqueous surfactant mixtures frequently pass through a marked gel phase at an active content of about 40–80%. This gel phase is marked by a high viscosity of at least 200 mPas (measured at 20° C. in a 30% strength by weight aqueous solution), which prevents the metered addition of such surfactant mixtures by pumping.

It should be expressly pointed out that with nonionic surfactants good detergency is ascribed to the appearance of pronounced gel phases on dilution with water. For instance, ethoxylated fatty acids have surfactant properties and are usually dilutable with water without gel phases, but are poor detergents; the same is true of alkyl alkoxylates based on short-chain alcohols. Alkoxylated fatty alcohols based on saturated or unsaturated alcohols are frequently pasty, inhomogeneous, pass through pronounced gel phases on dilution with water and hence are difficult to use on their own in textile pretreatment.

It is an object of the present invention to provide a nonionic surfactant mixture which is liquid and readily pumpable, which does not have a pronounced gel phase on dilution with water and which nonetheless possesses the high detergency of a surfactant that does pass through a gel phase.

SUMMARY OF THE INVENTION

Surprisingly, it has been found that surfactants that are viscous on their own and pass through pronounced gel phases with water become pumpable, and water-dilutable without pronounced gel phases, on addition of small amounts of additives that on their own do not have a strong surfactant action.

The present invention accordingly provides a surfactant mixture comprising 33–95 parts by weight, preferably 60 to 80 parts by weight, of at least one alkoxylated fatty alcohol (component I) of the formula I $$R^1-O-(CH_2\underset{\underset{R^2}{|}}{C}HO)_nH \qquad (I)$$

where $R^1$ is $C_9$–$C_{18}$-alkyl or $C_9$-$C_{18}$-alkenyl, $R^2$ is hydrogen or methyl, and n is from 5 to 30, and 5–67 parts by weight, preferably 20–40 parts by weight, of at least one alkoxylated fatty acid (component II) of the formula II $$R^1-\overset{\overset{O}{||}}{C}-O-(CH_2\underset{\underset{R^2}{|}}{C}HO)_nH \qquad (II)$$

where $R^1$ is $C_9$–$C_{18}$-alkyl or $C_9$–$C_{18}$-alkenyl, $R^2$ is hydrogen or methyl, and n is from 5 to 30, or 5–67 parts by weight, preferably 20–40 parts by weight, of at least one alkoxylated alcohol (component III) of the formula III $$R^3-O-(CH_2\underset{\underset{R^2}{|}}{C}HO)_nH \qquad (III)$$

where $R^3$ is $C_1$–$C_6$-alkyl, $R^2$ is hydrogen or methyl, and n is from 5 to 30, or 5–67 parts by weight, preferably 20–40 parts by weight, of a mixture of at least one alkoxylated fatty acid (component II) and at least one alkoxylated alcohol (component III).

DESCRIPTION OF THE PREFERRED EMBODIMENTS

Component I is an alkoxylated fatty alcohol of the formula I, preferably an alkoxylated fatty alcohol with a pronounced gel phase, of the formula I, where $R^1$ is $C_{10}$–$C_{15}$-alkyl or $C_{10}$–$C_{15}$-alkenyl and n is from 5 to 8.

Particularly suitable alkoxylated fatty alcohols are prepared from alcohols of the type coco fatty alcohol, oleyl alcohol, $C_{14/15}$ oxo alcohol, isotridecyl alcohol and $C_{9/11}$ oxo alcohol.

Component II is an alkoxylated fatty acid of the formula II, preferably an ethoxylated fatty acid that is dilutable with water without gel phase.

Component III is an alkoxylated lower alcohol, preferably with a molecular weight above 500.

The aforementioned alkoxylated compounds can be used both in the form of block copolymers or in the form of random copolymers.

In the case of the use of a mixture, the ratio of alkoxylated fatty acid (component II) to alkoxylated alcohol (component III) is customarily 1–9:9–1. Preferably, the surfactant mixture of this invention comprises 33.3 parts by weight of component I and 66.6 parts by weight of component II or component III or 80 parts by weight of component I and 20 parts by weight of component II or component III.

As part of the textile pretreatment, the claimed surfactant mixtures of this invention, which are based on nonionic components, may include other auxiliaries important for the pretreatment, for example, anionic complexing agents for the peroxide bleach, P-free dispersants of anionic provenance, e.g. gluconates, heptagluconates, acrylates, etc., foam inhibitors based on silicone or of the trialkyl phosphate type. Such auxiliaries are customarily included in an amount of up to 30% by weight, preferably 1–25% by weight, based on the surfactant mixture.

To intensify the washing process, the claimed nonionic systems may include washing surfactants of the anionic kind, for example alkane- or olefin-sulfonates, preferably linear alkanesulfonates, ethercarboxylates, sarcosides, petroleum sulfonates, alkylbenzenesulfonates, etc.

The surfactant mixtures of this invention provide the textile industry with surfactant mixtures for use as textile auxiliaries for man-made fibers and natural fibers, especially for the textile pretreatment of man-made fibers.

The hitherto adopted way of rendering nonionic surfactants pumpable, viz. prediluting with water, skipping the gel phases and supplying the textile industry with dilute surfactant systems, has become redundant as a result.

The surfactant mixtures of this invention make it possible to use alkoxylated fatty alcohols which are otherwise difficult to accommodate in textile pretreatment.

Advantageously, the surfactant mixtures of this invention have high detergency in the textile pretreatment even without gel phases. That is, the above statement that individual surfactants which are dilutable with water without gel phases, such as coco fatty acid ethoxylated with 10 mol of ethylene oxide, have only a moderate detergency in the textile sector, does not apply to the surfactant mixtures of this invention.

In addition to good detergency, the surfactant mixtures exhibit excellent foam formation, which is stable over a wide pH range.

EXAMPLES

A1) The surfactant used was a $C_{14/15}$ oxo alcohol with about 8 mol of ethylene oxide (component I).

Product data:

| | |
|---|---|
| Appearance at 20° C. | white soft paste |
| Pour point | about 20° C. |
| Drop point | about 30° C. |
| HLB | about 12 |
| Cloud point (DIN 53917) 5 g in 25 $cm^3$ of 25% strength aqueous BDG | 78 ± 2° C.; not pumpable |

This surfactant was blended with the following surfactants:

| | | |
|---|---|---|
| A: | Coco fatty acid · 10 EO | (component II) |
| B: | Oleic acid · 5 EO | (component II) |
| C: | Butanol · 10 EO · 10 PyO (random) | (component III) |
| D: | $C_{12/15}$ oxo alcohol · 7.5 EO · 4 PyO | (component I) |
| E: | $C_{10/12}$ Ziegler alcohol linear · 4 EO · 4 PyO | (component I) |

The following mixtures were prepared and tested for their pourability at room temperature:

| Surfactant | Ratio | Appearance | Viscosities |
|---|---|---|---|
| A1 | pure | paste | 1:1 or 1:2 with $H_2O$ |
| A | 1:1 | clear, liquid | low, low |
| B | 1:1 | clear, liquid | low, low |
| C | 1:1 | clear, liquid | low, low |
| D | 1:1 | clear, liquid | low, low |
| E | 1:2 | | low, low |
| A | 1:2 | clear, liquid | low, low |
| C | 1:2 | clear, liquid | low, low |
| D | 1:2 | clear, liquid | low, low |
| E | 1:2 | clear, liquid | low, low |
| A | 2:1 | clear, liquid | low, low |
| B | 2:1 | clear, liquid | low, low |
| C | 2:1 | clear, liquid | low, low |
| D | 2:1 | clear, liquid | low, low |
| E | 2:1 | clear, liquid | low, low |
| A | 3:1 | clear, liquid | low, low |
| B | 3:1 | clear, liquid | low, low |
| C | 3:1 | clear, liquid | low, low |
| D | 3:1 | clear, liquid | low, low |
| E | 3:1 | clear, liquid | low, low |
| A | 4:1 | clear, liquid | low, low |
| C | 4:1 | clear, liquid | low, low |
| D | 4:1 | clear, liquid | low, low |
| E | 4:1 | clear, liquid | low, low |

The foam heights and the persistance of the foam after 30, 60 and 120 sec in aqueous solutions were determined for a number of stable, pumpable mixtures having low gel phases (viscosity less than 100 mPas, measured at 20° C., in a 50% strength by weight or 33.3% strength by weight solution) on dilution with water. At the same time the deter-gency was determined in % whitening (reflectance) of cotton test fabrics.

| | Foam height (cm) | | | Detergency (% reflectance) | |
|---|---|---|---|---|---|
| | 30 sec | 60 sec | 120 sec | 40° C. | 80° C. |
| A1 | | | | | |
| acid | 21 | 19 | 17.5 | 50.5 | 51 |
| neutral | 26 | 23 | 20 | 48.2 | 58 |
| alkaline | 26 | 23 | 21 | 48.2 | 58 |
| A1/A 1:2 | | | | | |
| acid | 26 | 23 | 20 | 49 | 53 |
| neutral | 22 | 20 | 18 | 47 | 57 |
| alkaline | 22 | 21 | 19 | 48 | 47 |
| A1/C 1:2 | | | | | |
| acid | 30 | 25 | 23 | 48 | 47 |
| neutral | 22 | 20 | 17 | 47 | 49 |
| alkaline | 26 | 22 | 18 | 48 | 50 |
| A1/D 1:2 | | | | | |
| acid | 25 | 21 | 17 | 46 | 47 |
| neutral | 20 | 17 | 14 | 47 | 49 |
| alkaline | 23 | 17 | 15 | 48 | 49 |
| A1/E 1:2 | | | | | |
| acid | 27 | 22 | 19 | 49 | 47 |
| neutral | 22 | 17 | 14 | 51 | 48 |
| alkaline | 18 | 14 | 13 | 50 | 49 |
| A1/C 4:1 | | | | | |
| acid | 24 | 22 | 20 | 50 | 49 |
| neutral | 30 | 26 | 22 | 51 | 50 |
| alkaline | 22 | 20 | 18 | 50 | 51 |
| A1/E 4:1 | | | | | |
| acid | 23 | 21 | 18 | 49 | 49 |
| neutral | 28 | 23 | 21 | 50 | 51 |
| alkaline | 21 | 19 | 16 | 51 | 49 |

The mixtures of this invention are stable, produce nc increase in the foam heights and are similar in detergency tc the surfactant used alone.

What is claimed is:

1. A surfactant mixture consisting essentially of 33–95 parts by weight of at least one alkoxylated fatty alcohol (component I) of the formula I:

$$R^1-O-(CH_2\underset{\underset{R^2}{|}}{C}HO)_nH, \quad (I)$$

where, $R^1$ is $C_9$–$C_{18}$-alkyl or $C_9$–$C_{18}$-alkenyl, $R^2$ is independently hydrogen or methyl, and n is from 5 to 30, and 5–67 parts by weight of a mixture comprising at least one alkoxylated fatty acid (component II) of the formula II:

$$R^1-\overset{\overset{O}{||}}{C}-O-(CH_2\underset{\underset{R^2}{|}}{C}HO)_nH \quad (II)$$

where, $R^1$ is $C_9$–$C_8$-alkyl or $C_9$–$C_{18}$-alkenyl, $R^2$ is independently hydrogen or methyl, and n is from 5 to 30, and at least one alkoxylated alcohol (component III) of the formula III:

$$R^3-O-(CH_2\underset{\underset{R^2}{|}}{C}HO)_nH, \quad (III)$$

where, $R^3$ is $C_1$–$C_6$-alkyl, $R^2$ is independently hydrogen or methyl, and n is from 5 to 30, wherein the alkoxylated fatty acid (component II) and the alkoxylated alcohol (component III) are present in a weight ratio ranging from 1–9:9–1, and wherein the surfactant mixture optionally contains an anionic surfactant, an anionic complexing agent capable of complexing a peroxide bleach, a phosphate-free dispersant of anionic provernance, or a foam inhibitor based on silicone or trialkyphosphate, for pretreating textiles.

2. The surfactant mixture of claim 1, wherein the surfactant mixture includes said anionic surfactant, said anionic complexing agent capable of complexing a peroxide bleach, said phosphate-free dispersant of anionic provernance, or said foam inhibitor based on silicone or trialkyphosphate, in the amount of 1 to 25% by weight, based on the surfactant mixture.

3. The surfactant mixture of claim 1, wherein the phosphate-free dispersant of anionic provenance is a gluconate, a heptagluconate, or an acrylate.

4. The surfactant mixture of claim 1, wherein components I, II, and III are each a block copolymer or a random copolymer.

5. The surfactant mixture of claim 1, wherein the alkoxylated fatty alcohol (component I) comprises a compound having essentially a gel phase, and wherein $R^1$ of the alkoxylated fatty alcohol is $C_{10}$–$C_{15}$-alkyl or $C_{10}$–$C_{15}$-alkenyl, and n of the alkoxylated fatty alcohol is from 5 to 8.

6. The surfactant mixture of claim 1, wherein the alkoxylated fatty alcohol (component I) is prepared from a coco fatty alcohol, an oleyl alcohol, a $C_{14/15}$ oxo alcohol, an isotridecyl alcohol, or a $C_{9/11}$ oxo alcohol.

7. The surfactant mixture of claim 1, wherein the alkoxylated fatty acid (component II) comprises an ethoxylated fatty acid.

8. The surfactant mixture of claim 7, wherein the ethoxylated fatty acid (component II) is dilutable with water without passing through a gel phase.

9. The surfactant mixture of claim 1, wherein the alkoxylated alcohol (component III) has a molecular weight of greater than 500.

10. The surfactant mixture of claim 1, wherein the anionic surfactant is present in said mixture and is an alkane sulfonate or an olefin sulfonate.

11. The surfactant mixture of claim 10, wherein the alkane or olefin sulfonate is a linear alkane sulfonate, an ether carboxylate, a sarcoside, a petroleum sulfonate, or an alkylbenzene sulfonate.

12. The surfactant mixture of claim 1, wherein the surfactant mixture is nonionic, liquid, pumpable, and dilutable with water without passing through a gel phase while maintaining its detergency characteristics.

13. A process for textile pretreatment of fibers comprising pretreating the fibers with the surfactant mixture of claim 1.

* * * * *